US011697871B2

(12) United States Patent
Chen et al.

(10) Patent No.: US 11,697,871 B2
(45) Date of Patent: Jul. 11, 2023

(54) THERMAL BARRIER COATINGS AND PROCESSES

(71) Applicant: OERLIKON METCO (US) INC., Westbury, NY (US)

(72) Inventors: Dianying Chen, West Chester, OH (US); Christopher G. Dambra, Flushing, NY (US); Mitchell R. Dorfman, Smithtown, NY (US)

(73) Assignee: OERLIKON METCO (US) INC., Westbury, NY (US)

( * ) Notice: Subject to any disclaimer, the term of this patent is extended or adjusted under 35 U.S.C. 154(b) by 883 days.

(21) Appl. No.: 15/116,654

(22) PCT Filed: Feb. 19, 2015

(86) PCT No.: PCT/US2015/016586

§ 371 (c)(1),
(2) Date: Aug. 4, 2016

(87) PCT Pub. No.: WO2015/127052

PCT Pub. Date: Aug. 27, 2015

(65) Prior Publication Data

US 2016/0348226 A1 Dec. 1, 2016

Related U.S. Application Data

(60) Provisional application No. 61/942,984, filed on Feb. 21, 2014.

(51) Int. Cl.
*F01D 5/28* (2006.01)
*C23C 4/10* (2016.01)
(Continued)

(52) U.S. Cl.
CPC ..... *C23C 4/10* (2013.01); *C23C 4/02* (2013.01); *C23C 4/134* (2016.01);
(Continued)

(58) Field of Classification Search
CPC ..... C23C 28/3455; F01D 5/288
See application file for complete search history.

(56) References Cited

U.S. PATENT DOCUMENTS 4,457,948 A 7/1984 Ruckle
5,073,433 A 12/1991 Taylor
(Continued)

FOREIGN PATENT DOCUMENTS

CN 1642734 7/2005
CN 1903562 1/2007
(Continued)

OTHER PUBLICATIONS

American Elements, "Zirconium Oxide", p. 1-6; Accessed on Feb. 12, 2019 at https://www.americanelements.com/zirconium-oxide-1314-23-4.*

(Continued)

*Primary Examiner* — Mark Ruthkosky
*Assistant Examiner* — Julia L Rummel
(74) *Attorney, Agent, or Firm* — Greenblum & Bernstein, P.L.C.

(57) ABSTRACT

Articles coated with a porous, segmented thermal barrier coating. The coating described has a density less than about 88% of the theoretical density. Multi-layer articles and methods of applying the thermal barrier coatings to an article are also described.

2 Claims, 3 Drawing Sheets

(51) Int. Cl.
*C23C 4/02* (2006.01)
*C23C 28/00* (2006.01)
*C23C 4/134* (2016.01)

(52) U.S. Cl.
CPC ..... *C23C 28/3215* (2013.01); *C23C 28/3455* (2013.01); *F01D 5/288* (2013.01)

(56) References Cited

U.S. PATENT DOCUMENTS

| | | | | |
|---|---|---|---|---|
| 5,705,231 | A | 1/1998 | Nissley | |
| 8,197,950 | B2 | 6/2012 | Taylor | |
| 2003/0138658 | A1 | 7/2003 | Alan | |
| 2003/0228441 | A1 | 12/2003 | Subramanian | |
| 2004/0229031 | A1* | 11/2004 | Gell | B82Y 30/00 428/323 |
| 2005/0170200 | A1 | 8/2005 | Nagaraj | |
| 2006/0269775 | A1 | 11/2006 | Hai et al. | |
| 2007/0207271 | A1* | 9/2007 | Mueller | C04B 35/62665 427/453 |
| 2008/0145629 | A1 | 6/2008 | Anoshkina | |
| 2008/0226879 | A1* | 9/2008 | Strock | C23C 4/134 428/195.1 |
| 2009/0252985 | A1 | 10/2009 | Nagaraj | |
| 2009/0311508 | A1 | 12/2009 | Stamm | |
| 2010/0062173 | A1 | 3/2010 | Torigoe | |
| 2010/0272982 | A1 | 10/2010 | Dickinson | |
| 2011/0164961 | A1 | 7/2011 | Taylor | |
| 2011/0164963 | A1 | 7/2011 | Taylor | |
| 2011/0171488 | A1 | 7/2011 | Taylor | |
| 2013/0330507 | A1 | 12/2013 | Taylor | |

FOREIGN PATENT DOCUMENTS

| | | |
|---|---|---|
| EP | 0 707 091 | 4/1996 |
| EP | 1 295 964 | 3/2003 |
| EP | 2 336 381 | 6/2011 |
| JP | 11172404 | 6/1999 |
| JP | 2011037702 | 2/2011 |
| WO | 03/061961 | 7/2003 |
| WO | 2008/140479 | 11/2008 |
| WO | 2010/053687 | 5/2010 |
| WO | 2011/008719 | 1/2011 |
| WO | 2011/019486 | 2/2011 |

OTHER PUBLICATIONS

Richardson, D.; "Modern Ceramic Engineering", 2006, CRC Press; p. 186-187.*

American Elements, "Hafnium Oxide", p. 1; Accessed on Sep. 8, 2021 at https://www.americanelements.com/hafnium-oxide-12055-23-1.*

Richardson, D.; "Modern Ceramic Engineering Properties, Processing, and Use in Design", 2006, CRC Press; p. 186-187.*

Translation of Chinese Office Action issued in Application No. 201580007489.8 (7 pages).

EPO Search Report and Written Opinion issued in Application No. 15 75 1836.

EPO Action issued in Application No. 15 751 836 (6 pages).

PCT Search Report and Written Opinion issued in International Application No. PCT/US15/16586.

Hardwicke et al., "Advances in Thermal Spray Coatings for Gas Turbines and Energy Generation; A Review", Journal of Thermal Spray Technology, vol. 22(5), Jun. 2013, pp. 564-576.

JP Action and English translation issued in Application No. 2016-550630 dated Feb. 18, 2019 (9 pages).

JP Action (English translation) issuedin Application No. 2016-550630 dated Oct. 23, 2019 (3 pages).

* cited by examiner

THERMAL BARRIER COATINGS AND PROCESSES

CROSS-REFERENCE TO RELATED APPLICATIONS

The present application is a U.S. National Stage of International Patent Application No. PCT/US2015/016586 filed Feb. 19, 2015 which published as WO/2015/127052 on Aug. 27, 2015, and claims the benefit of U.S. Provisional Patent Application No. 61/942,984 filed Feb. 21, 2014, the disclosures of which are expressly incorporated herein by reference.

TECHNICAL FIELD

The field of art to which this invention generally pertains is thermal spray process coating.

BACKGROUND

Thermal spraying is a coating process in which various materials in heated or melted form are sprayed onto a surface. The coating material is generally heated by electrical plasma or arc. Coating materials used include such things as metals, alloys, and ceramics, among others. Depending on the intended use, coating quality is typically measured by such things as density, porosity, sintering resistance, thermal conductivity, strain tolerance, etc. Many things can influence these and other coating properties, such as particulars of the coating material used, particulars of the plasma gas used, flow rates, power levels, torch distance, particulars of the substrate, etc. Because of their properties, these types of coatings are generally used to protect structural materials against high temperatures, corrosion, erosion, wear, etc. Thus, there is a continuing search for ways to improve the properties and performance of these coatings, for these uses, as well as others.

The methods and materials described herein meet the challenges described above, including, among other things, improved coating properties and performance.

BRIEF SUMMARY

A method of applying a thermal barrier coating to an article is described including thermally spraying plasma heated particle coating materials onto the surface of the article to produce a porous, segmented thermal barrier coating having a density less than about 88% of the theoretical density.

Additional embodiments include: the method described above where the coating materials are applied with a cascaded plasma gun or a conventional thermal spray plasma gun for example 9M or F4 guns; the method described above where the coating materials are applied with a cascaded arc gun technology such as SinplexPro™ plasma gun or a TriplexPro™ plasma gun; the method described above where argon is used as a primary plasma gas; the method described above where hydrogen is used as a secondary plasma gas; the method described above where the plasma enthalpy is about 14,000 KJ/Kg to about 24,000 KJ/Kg; the method described above where the plasma enthalpy is about 18,000 KJ/Kg; the method described above where the ratio of argon to hydrogen is about 6:1 to about 18:1; the method described above where the ratio of argon to hydrogen is about 9:1 to about 12:1; the method described above where the feeding rate of the coating material is about 30 g/min to about 180 g/min; the method described above where the feeding rate is about 60 g/min to about 120 g/min; the method described above where the average sprayed particle temperature is about 2700° C. to about 3300° C.; the method described above where the average sprayed particle temperature is about 2700° C. to about 3000° C.; the method described above where the average sprayed particle velocity is about 180 m/s to about 280 m/s; the method described above where he method of claim 30, wherein the average sprayed particle velocity is about 190 m/s to about 250 m/s; the method described above where the coating has a density equal to or less than about 4.9 g/cc; the method described above where the coating has a density of about 4.2 g/cc to about 4.9 g/cc; the method described above where the coating has a density of about 3.0 g/cc to about 5.5 g/cc; the method described above where the coating has at least about 5 macrocracks per linear inch; the method described above where the coating has about 5 and to about 60 macrocracks per linear inch; the method described above where the coating has a porosity greater than about 5% by volume, preferably up to 20% by volume, and could go up to 25% by volume; _the method described above where the coating material comprises zirconium oxide stabilized with one or more of magnesia, ceria, yttria, ytterbia, dysposia, gadolia, erbia, neodymia, lanthanum oxide, and/or strontium oxide, typically in amounts of about 5 to about 75 weight %, preferably about 5 to about 50 weight %, and more preferably about 5 to about 15 weight %; the method described above where hafnium oxide is substituted for at least part of (or all of) the zirconium oxide; the method described above where the coating material is yttria stabilized zirconia.

Additional embodiments also include: the method described above including applying at least one oxidation resistant bond coat on the article; the method described above where including applying a dense legacy yttria stabilized zirconia layer on top of the bond coat; the method described above including applying a dense segmented yttria stabilized zirconia layer on top of the bond coat; the method described above including applying at least one intermediate coating on top of the bond coat; the method described above including applying at least one top coating on top of the bond coat; the method described above where the intermediate coating comprises at least one layer of legacy porous yttria stabilized zirconia, dense coatings, porous segmented coatings, and/or dense segmented coatings; the method described above where the top coating comprises at least one layer of legacy porous yttria stabilized zirconia, dense coatings, porous segmented coatings, and/or dense segmented coatings; the method described above including applying at least one porous segmented coating as an intermediate coating; the method described above including applying at least one porous segmented coating as a top coating; the method described above where the bond coat is up to about 200 microns thick; the method described above where the intermediate coating is up to about 400 microns thick; the method described above where the intermediate coating is between about 50 microns and 400 microns thick; the method described above where the top coating is up to about 800 microns thick; the method described above where the top coating is between about 100 microns and about 800 microns thick; the method described above where the intermediate coating comprises at least one layer of strain tolerant coating; the method described above where the bond coat comprises MCRAlY, where M is Ni, Co and/or Fe; the method described above where the bond coat is NiCr, NiAl, and/or NiCrAlY; the method described above where the bond coat additionally contains small amounts, for example trace to 0.6_weight percent of Re, Hf, and/or Si; the method described above where the coating has decreased thermal conductivity when compared to legacy zirconia thermal barrier coatings, high strain tolerance when compared to legacy zirconia thermal barrier coatings, high sintering resistance and/or improved_thermal cycle life when compared to legacy zirconia thermal barrier coatings; the method described above where the particles have a particle size of between about 10 microns and about 176 microns; the method described above where the apparent density of the coating material or powder is between about 1.0 grams/cc and about 3.0 g/cc; the method described above where the total impurity of oxides in the particles is less than about 0.5% by weight; the method described above where the oxides are from a group comprising but not limited to $SiO_2$, $Al2O_3$, iron oxide, sodium oxide, CaO, MgO and/or $TiO_2$; the method described above where the total impurity of oxides in the particles is less than about 0.15% by weight; the method described above where the powder contains less than about 0.05% by weight uranium and/or thorium; the method described above where the powder contains less than about 0.02% by weight uranium and/or thorium; the method described above where the powder comprises a bimodal distribution containing about 75% by weight plasma densified particles and about 25% by weight spray dried powder; the method described above where the plasma densified powder are about 11 μm to about 75 μm in diameter and the spray dried powder are about 75 m to about 180 μm in diameter. Additionally, the powder can be plasma densified, agglomerated and sintered, fused and crushed, or spray dried, or any combination of these in varying percentages.

Articles coated with porous, segmented thermal barrier coatings are also described where the coatings have a density less than about 88% of the theoretical density.

Additional embodiments include: the article described above where the coating has a density of about 3.0 g/cc to about 5.5 g/cc, about 5 macrocracks per linear inch to about 60 microcracks per linear inch, and a porosity between about 5% by volume up to about 25% by volume; the article described above where the coating includes zirconium oxide stabilized with one or more of magnesia, ceria, yttria, ytterbia, dysposia, gadolia, erbia, neodymia, lanthanum oxide, and/or strontium oxide; the article described above where hafnium oxide is substituted for at least part of the zirconium oxide; the article described above where the coating comprises yttria stabilized zirconia; the article described above including at least one oxidation resistant bond coat on the article; the article described above including a dense legacy or segmented yttria stabilized zirconia layer on top of the bond coat; the article described above including at least one intermediate coating on top of the bond coat; the article described above including at least one top coating on top of the bond coat; the article described above containing at least one porous segmented coating as an intermediate or top coating.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, and wherein.

DETAILED DESCRIPTION

Figure 1A:
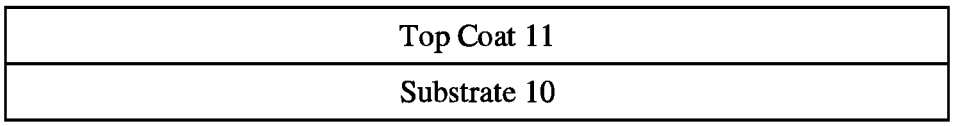
FIGS. 1A, 1B and 1C show schematic representations of various coated articles as described herein.

The particulars shown herein are by way of example and for purposes of illustrative discussion of the various embodiments of the present invention only and are presented in the cause of providing what is believed to be the most useful and readily understood description of the principles and conceptual aspects of the invention. In this regard, no attempt is made to show details of the invention in more detail than is necessary for a fundamental understanding of the invention, the description making apparent to those skilled in the art how the several forms of the invention may be embodied in practice.

The present invention will now be described by reference to more detailed embodiments. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise. All publications, patent applications, patents, and other references mentioned herein are expressly incorporated by reference in their entirety.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Every numerical range given throughout this specification will include every narrower numerical range that falls within such broader numerical range, as if such narrower numerical ranges were all expressly written herein.

Additional advantages of the invention will be set forth in part in the description which follows, and in part will be obvious from the description, or may be learned by practice of the invention. It is to be understood that both the foregoing general description and the following detailed description are exemplary and explanatory only and are not restrictive of the invention, as claimed.

Thermal barrier coatings are well known including those with vertical cracks. There are numerous publications and patents disclosing thermal barrier coatings with vertical cracks. However, such coatings typically have a dense microstructure. For example, U.S. Pat. No. 5,073,433 to Taylor and U.S. Pat. No. 8,197,950 to Taylor et al. disclose segmented coatings having a density of 5.47 g/cc (grams/cubic centimeter) to 5.55 g/cc which is greater than 88% of the theoretical density. The disclosure of each of these US patents is herein expressly incorporated by reference in its entirety.

Coatings and methods of making such coatings are described herein where the coating advantageously is highly strain tolerant and has low thermal conductivity. The coating is also advantageously a sintering resistant thermal barrier coating for high temperature applications which can protect a metallic component and utilize one or more oxidation resistant bond coats.

Figure 1B:
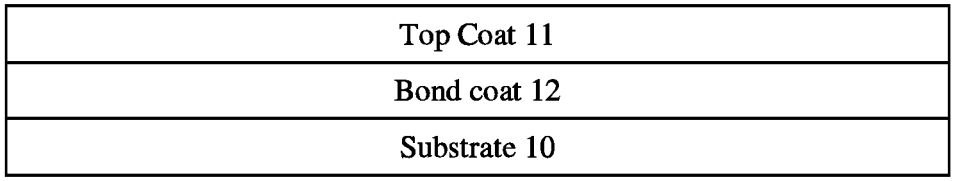
Figure 1C:
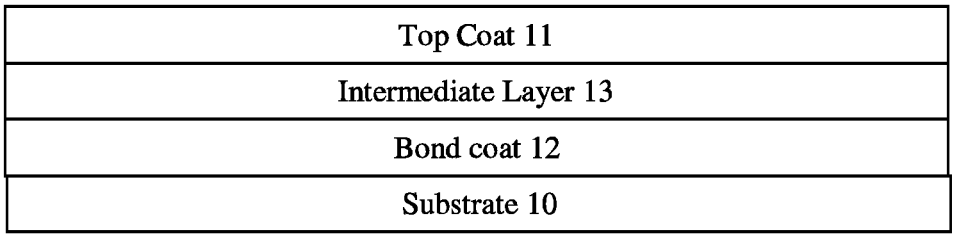

FIG. 1A shows a basic structure as described herein, where a substrate material (10) is coated with a thermal barrier top coat (11) as also described herein. Other options shown in FIGS. 1B and 1C include multilayer versions, including the addition of a bond coat (12) on the substrate and optional intermediate layers (13).

Figure 2:
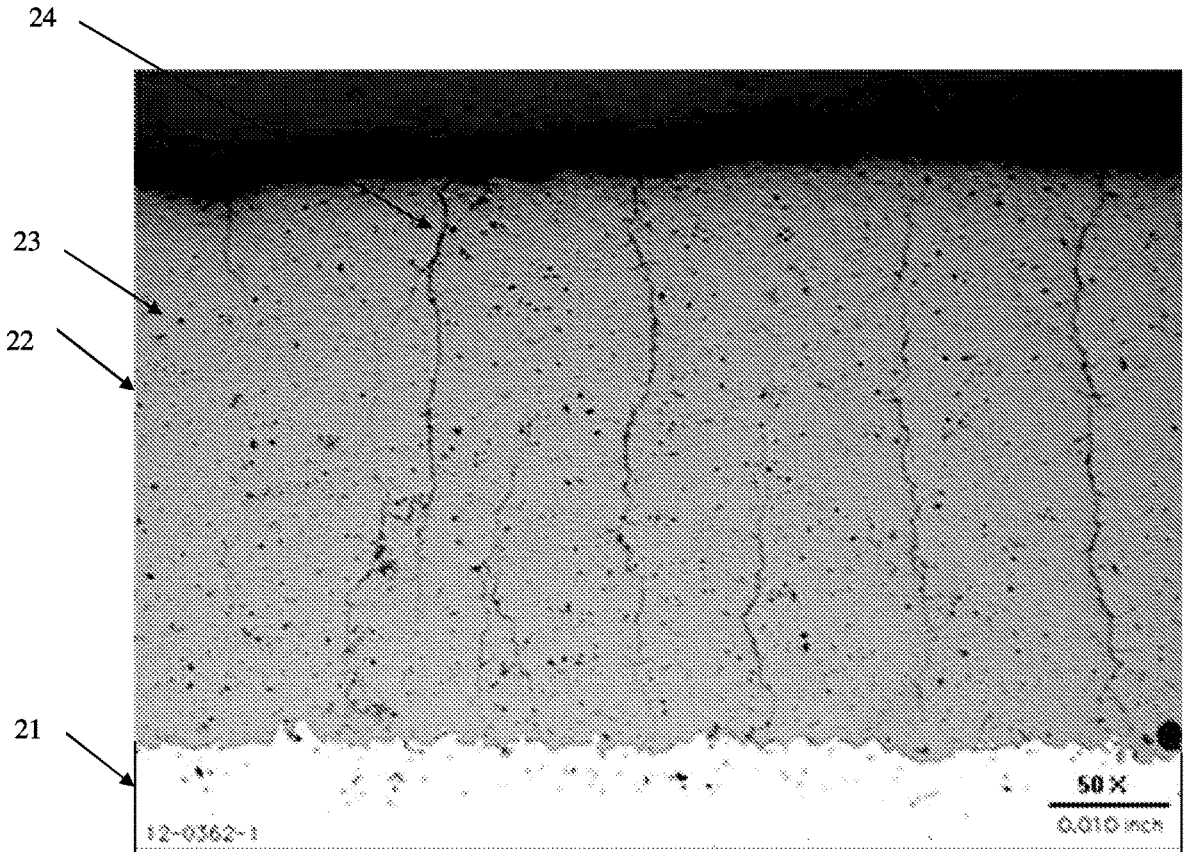
FIG. 2 shows typical thermal barrier coatings.

FIG. 2 shows a typical dense vertically cracked thermal barrier coating (TBC) coating as described, for example, in *Advances in Thermal Spray Coatings for Gas Turbines and Energy Generation: A Review*, Journal of Thermal Spray Technology, Volume 22(5), pages 564-576, June 2013, the disclosure of which is herein expressly incorporated by reference in its entirety. Referring to FIG. 2, the substrate material (21) is shown coated with the thermal barrier coating (22). Pores (23) and macrocracks (24) can also be seen.

Figure 3:
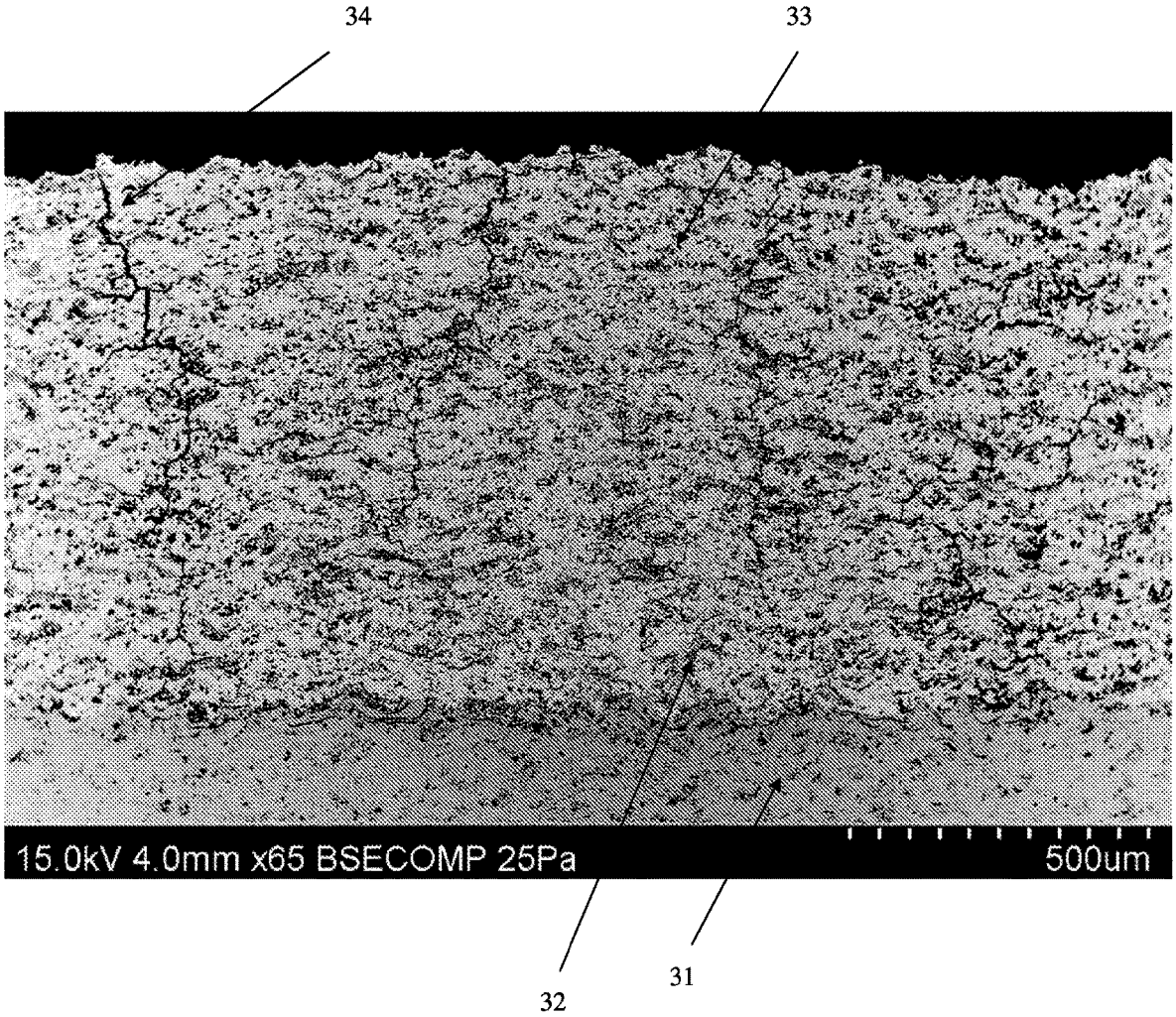
FIG. 3 shows a typical thermal barrier coating as described herein.

FIG. 3 shows a polished cross-section of a porous and segmented plasma sprayed zirconium oxide-yttrium oxide (YSZ) coating in accordance with the invention and having a porosity of about 20% and about 35 vertical macrocracks per inch. Referring to FIG. 3, the substrate material (31) is shown coated with the thermal barrier coating (32). Pores (33) and macrocracks (34) can also be seen.

It would be advantageous to make an air plasma spray segmented coating with a coating density less than 88% of the theoretical density. This type of coating can be made by controlling the particle melting status and the stress levels in order to increase the porosity of the coating. The increased porosity can advantageously increase the coating sintering resistance, lower the thermal conductivity and contribute to the strain tolerance enhancement, especially when combined with vertical cracks.

The articles described herein include a thermal barrier coating having a decreased thermal conductivity, a higher strain tolerance, a higher sintering resistance and improved thermal cyclic fatigue resistance compared to prior coatings. The thermal barrier coating can be made which has a porous and vertically segmented microstructure. This coating can, for example, advantageously be a yttria stabilized zirconia (YSZ) coating have a typical density ranging from 4.2 g/cc to 4.9 g/cc or where the coating has a density of about 3.0 g/cc to about 5.5 g/cc; and with a vertical cracks density of between about 5 and about 60 macrocracks per linear inch. These coating typically have a thermal cycle life that is between 1.4 and 1.6 times higher than traditionally dense segmented thermal barrier coatings. The coatings can be plasma sprayed using conventional thermal spraying techniques and equipment modified as described herein.

Non-limiting examples of coatings made in accordance with the invention include the following:

EXAMPLE

A porous segmented yttria stabilized zirconia thermal barrier coating is formed by plasma spraying a YSZ spherical powder. The YSZ powder consists of 7 weight percent yttria and a balance of zirconia having a particle size ranging from 5 μm to 180 μm and preferably between 11 μm and 125 μm. A possible bimodal distribution can utilize 75 wt % plasma densified material (particles size ranging from 11 μm-75 μm) with 25 wt % of spray dried material (particle size ranging from 75 μm-180 μm). A possible straight material can utilize plasma densified YSZ powder with particle size 11 μm-110 μm. The YSZ powder is injected into the plasma torch radially. In embodiments the plasma torch utilizes cascaded gun technology and can be a TriplexPro™-210 plasma gun, SinplexPro™ plasma gun, or even a conventional plasma gun such as an F4 gun or 9 MB gun made by Oerlikon Metco. A plasma gun utilizing cascaded gun technology is preferred when the coating is to be applied over a metallic or ceramic composite substrate.

During plasma spraying, the plasma spraying parameters should be controlled so that some particles are fully melted and some particles will be only partially melted or remain un-melted. Typically, the substrate should be preheated to about 500° C. before applying the coating on the same.

The YSZ coating applied in this way can advantageously have a desirable porosity and be composed of fully melted splats, as well as partially melted and un-melted particles. This YSZ coating can also advantageously have a density ranging from about 4.2 g/cc to about 4.9 g/cc (i.e., less than 88% of the theoretical density) and can include between about 5 and about 60 vertical macrocracks per linear inch measured in a line parallel to the surface of the substrate. The YSZ coating can also be expected to exhibit desirable properties such as low thermal conductivity, greatly improved sintering resistance and enhanced strain tolerance.

In the above example, a coating utilizing 7-8 weight percent (wt %) YSZ materials and made by the known Oerlikon Metco HOSP process has been demonstrated. However, the invention is not so limited and can be extended to many different zirconium oxide thermal barrier systems using various powder manufacturing processes.

In non-limiting examples, many types of material systems can be utilized such as: zirconium oxide systems stabilized with one or more combinations of magnesia, ceria, yttria, ytterbia, dysposia, gadolia, erbia, neodymia, lanthanum oxide, strontium oxide. Hafnium oxide can be substituted for part or all of zirconium oxide.

In addition, many types of material manufacturing processes can be used such as a manufacturing process which utilizes spray dried powder manufacturing routes or processes (0-100 wt % pre-alloyed or 0-100 wt % unreacted constituents) with an organic binder; spray dried and sintered materials; spray dried and plasma densified materials; as well as a chemical precipitated blend of two or more of various manufacturing routes. A blend of fused and crushed materials made in accordance with one or more of these three manufacturing routes can also be utilized.

In non-limiting examples, the powder properties can include the following: a particle size of between about 10 and about 176 microns; apparent density of between about 1.0 grams/cc- and about 3.0 g/cc; a purity wherein a total impurity of oxides such as $SiO_2$, $Al2O_3$, iron oxide, sodium oxide, CaO, MgO and $TiO_2$ is under 0.5 wt % and preferably less than 0.15 wt %; a radioactivity that is less than 0.05 wt % uranium and thorium and preferably less than 0.02 wt %; a possible bimodal distribution can utilize 75 wt % plasma densified material (particles size ranging from 11 μm-75 μm) with 25 wt % of spray dried material (particle size ranging from 75 μm-180 μm).

In non-limiting examples, the coating can be either a duel layer system which utilizes an oxidation resistant bond coat and a porous segmented top coat or a multi-layer system which utilizes dense legacies_of 7-8 wt % YSZ or even a dense segmented YSZ on top of oxidation resistant bond coat. The coating can also be a multi-layer coating with varied coating microstructures including one or more intermediate coatings and one or more top coatings on an oxidation resistant bond coat substrate. The intermediate coatings can be one or several layers of the legacy porous YSZ coatings, dense coatings, porous segmented coatings, dense segmented coatings or any combination of the same. The top coating or coatings can be one or several layers of the legacy porous YSZ coating, dense coatings, porous segmented coatings, dense segmented coatings or any combination of the same. In the multilayer coating applications, the one or more porous segmented coatings can at least appear as either an intermediate coating or a top coating layer. Typical coating thickness can include a bond coat of up to 200 microns, an intermediate coating of between about 50 and 400 microns, and a top coat of between about 100 and about 800 microns.

In non-limiting embodiments, the bond coating layers can typically be NiCr, NrAl, NiCrAlY or other MCRAlY containing materials where M stand for combinations of Ni, Co and/or Iron. The MCrAlY's may also contain trace amount of Re, Hf, Si.

The coated articles produced have a porous, segmented thermal barrier coating where the coating has a density less than about 88% of the theoretical density. Additional non-limiting embodiments include: the article described above where the coating has a density equal to or less than about 4.9 g/cc; the article described above where the coating has a density of about 4.2 g/cc to about 4.9 g/cc; the article described above where the coating has a density of about 3.0 g/cc to about 5.5 g/cc; the article described above where the coating has at least about 5 macrocracks per linear inch; the article described above where the coating has about 5 and to about 60 macrocracks per linear inch; the article described above where the coating has a porosity greater than about 5% by volume, preferably up to 20% by volume, and could go up to 25% by volume; the article described above where the coating comprises zirconium oxide stabilized with one or more of magnesia, ceria, yttria, ytterbia, dysposia, gadolia, erbia, neodymia, lanthanum oxide, and/or strontium oxide; the article described above where hafnium oxide is substituted for at least part of the zirconium oxide; the article described above where the coating is yttria stabilized zirconia;

Additional non-limiting embodiments also include: the article described above including at least one oxidation resistant bond coat on the article; the article described above including a dense legacy 7-8 weight percent yttria stabilized zirconia layer on top of the bond coat; the article described above including a dense segmented yttria stabilized zirconia layer on top of the bond coat; the article described above including at least one intermediate coating on top of the bond coat; the article described above including at least one top coating on top of the bond coat; the article described above where the intermediate coating comprises at least one layer of legacy porous yttria stabilized zirconia, dense coatings, porous segmented coatings, and/or dense segmented coatings; the article and method described above where the intermediate layers can be: 1) traditional 5 to 10 weight % YSZ coating structures, 2) dense YSZ with less than 5% porosity or 3) dense, segmented YSZ; the article described above where the top coating comprises at least one layer of legacy porous yttria stabilized zirconia, dense coatings, porous segmented coatings, and/or dense segmented coatings; the article described above containing at least one porous segmented coating as an intermediate coating; the article described above containing at least one porous segmented coating as a top coating; the article described above where the bond coat is up to about 200 microns thick; the article described above where the intermediate coating is up to about 400 microns thick; the article described above where the intermediate coating is between about 50 microns and 400 microns thick; the article described above where the top coating is up to about 800 microns thick; the article described above where the top coating is between about 100 microns and about 800 microns thick; the article described above where the intermediate coating comprises at least one layer of strain tolerant coating; the article described above where the bond coat comprises MCRAlY, where M is Ni, Co and/or Fe; the article described above where the bond coat is NiCr, NiAl, and/or NiCrAlY; the article described above where the bond coat additionally contains small amounts, for example trace to 0.6 weight percent of Re, Hf, and/or Si; the article described above where the coating has decreased thermal conductivity when compared to legacy zirconia thermal barrier coatings, high strain tolerance when compared to legacy zirconia thermal barrier coatings, high sintering resistance and/or improved thermal cycle life when compared to legacy zirconia thermal barrier coatings.

It should be noted that the type of powder manufacturing process can effect coating microstructure. Powder purity, powder particle size, heat input into powder, as well as the inter relationship between powder and spray parameters can effect coating microstructure and also be configured to achieve optimum microstructure such as a porous and segmented TBC.

Additionally, one should be mindful of the importance of semi-melted, and un-melted metal oxide particles entrapped within thermal barrier coating for reduced thermal conductivity, improved sintering resistance and added thermal cyclic life.

In accordance with an advantageous embodiment of the invention, a porous segmented coating can be formed by utilizing a SinplexPro™ plasma gun with a 9 mm spraying nozzle. Argon and hydrogen are used as the primary and the secondary plasma gases, respectively. The plasma enthalpy used can range from 14000 KJ/Kg (kiloJoules/kilogram) to 24000 KJ/Kg, preferably 18000 KJ/Kg. The ratio of argon and hydrogen can be between 6-18, preferably 9-12. The feeding rate can range from 30 g/min (grams/minute) to 180 g/min, preferably 60 g/min-120 g/min. The average particle temperature and velocity can range from 2700° C.-3300° C., 180 m/s (meters/second)-280 m/s, respectively. Preferably, the average temperature is between 2700° C.-3000° C. and an average velocity is between 190 m/s-250 m/s.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. An article coated with a porous, segmented strain tolerant yttria stabilized zirconia (YSZ) thermal barrier coating applied by plasma spraying a spray dried YSZ spherical powder material having a bimodal distribution of 75 weight percent plasma densified material with a particle size range of 11 μm to 75 μm and 25 weight percent spray dried material with a particle size range of 75 μm to 180 μm, wherein the YSZ thermal barrier coating comprises:

a density ranging between 4.2 g/cc and 4.9 g/cc;

portions formed from fully melted splats;

portions formed from partially melted and un-melted particles; and between 5 and 60 vertical macrocracks per linear inch.

2. An article coated with a porous, segmented strain tolerant thermal barrier coating applied by plasma spraying a spray dried powder material having a bimodal distribution of 75 weight percent plasma densified material with a particle size range of 11 μm to 75 μm and 25 weight percent spray dried material with a particle size range of 75 μm to 180 μm, wherein the coating comprises:

a density ranging from 3.0 g/cc to 5.5 g/cc;

portions formed from fully melted splats;

portions formed from partially melted and un-melted particles; and between 5 and 60 vertical macrocracks per linear inch, wherein the coating comprises zirconium oxide stabilized with one or more of yttria and ytterbia.

* * * * *